United States Patent [19]

Howe

[11] 4,240,359

[45] Dec. 23, 1980

[54] FREIGHT CARRIER

[75] Inventor: Peter Howe, St. Annes-on-Sea, England

[73] Assignee: Dorothy Elizabeth Howe, Lancashire, England

[21] Appl. No.: 907,496

[22] Filed: May 19, 1978

[30] Foreign Application Priority Data

May 20, 1977 [GB] United Kingdom ..... 21474/77

[51] Int. Cl.[3] ..... B61D 17/06; B65D 19/00

[52] U.S. Cl. ..... 108/53.1; 105/381; 108/55.1; 108/56.1; 220/7

[58] Field of Search ..... 108/53.1, 53.5, 55.1–55.5, 108/56.1; 220/7, 6, 1.5; 211/195, 194; 206/600; 248/500; 105/366 B, 366 C, 366 D, 366 A, 366 E, 464, 465, 381, 363; 292/257; 24/221 RC, 221 R

[56] References Cited

U.S. PATENT DOCUMENTS

| | | | |
|---|---|---|---|
| 377,648 | 2/1888 | Sinning | 292/257 |
| 1,229,851 | 6/1917 | Abercrombie | 292/257 |
| 3,529,741 | 9/1970 | Walker et al. | 220/1.5 X |
| 3,664,273 | 5/1972 | Howe | 108/53.1 |
| 3,872,555 | 3/1975 | Link et al. | 220/1.5 X |
| 3,924,544 | 12/1975 | Grau et al. | 24/221 RC X |

FOREIGN PATENT DOCUMENTS

| | | | |
|---|---|---|---|
| 2315442 | 1/1977 | France | 108/55.1 |
| 1430991 | 4/1976 | United Kingdom | 105/366 C |

*Primary Examiner*—William E. Lyddane
*Attorney, Agent, or Firm*—Norris & Bateman

[57] ABSTRACT

A freight carrier having a base structure forming a freight carrying platform which is provided at each corner with a corner post pivotally mounted for movement between an upright erect position and a folded position in which the post lies parallel to the platform. An interlocking mechanism is provided at each corner of the carrier to enable the carrier with the corner posts in their folded position, to be interlocked with a similar carrier which is stacked thereon and the interlocking mechanism includes a clamping arrangement to enable the stacked interlocked carriers to be clamped together. The interlocking mechanism is also arranged to lock an associated corner post in the erect position and clamps the corner post to the base structure in this erect position.

3 Claims, 4 Drawing Figures

FREIGHT CARRIER

This invention relates to freight carriers or containers of the type usually known as cargo flats and more particularly but not exclusively to the type of freight carrier described in British Pat. Nos. 1,252,000 and 1,432,542.

This type offreight carrier comprises a substantially flat rectangular base structure, forming a freight carrying platform, having a post member at each corner thereof which is pivotally mounted on the base structure and is capable of being moved between a folded position in which the post lies parallel to and adjacent to the base structure and an erected position in which the post extends upwardly from the base structure.

When the posts are in their erected positions, one or more cross members can be connected therebetween to form side and end members of the carrier and in certain types of carrier the two posts at each end of the base structure are permanently connected together by one or more cross members to form a unitary structure. With the posts erected and the sides and ends thereof in position, the carrier forms an enclosure or container for freight or cargo which is loaded on the base structure thereof and it is usual to provide an arrangement for locking the posts in their erected position.

When the carrier is empty and the posts are in their folded position, one or more carriers can be stacked one upon another to save space when empty carriers are being transported and it is usual to provide an interlocking arrangement on each freight carrier for connecting the carrier to a similar carrier which is stacked thereon.

According to one aspect of this invention, a freight carrier comprises a base structure forming a freight carrying platform and connecting apparatus for releasably connecting the carrier to a similar carrier which is stacked thereon wherein the connecting apparatus includes interlocking means for interlocking the superposed carriers together and clamping means for drawing the superposed carriers together after interlocking has taken place.

Preferably, the connecting apparatus is mounted on the base structure of the carrier and one connecting apparatus may be disposed at or adjacent to each corner of the base structure.

The interlocking means of the connecting apparatus, preferably, comprises a rotatable interlocking member having a head which can pass through a hole in a base structure of the similar carrier stacked on the carrier having the interlocking means which the rotatable interlocking member is in a disengaged position on its carrier, but is prevented from passing through that hole when the rotatable member is turned into an engaged position.

Preferably, also, the rotatable interlocking member is slidably movable relative to the base structure of the carrier along the rotational axis thereof and the clamping means urges the interlocking member slidably towards the base structure of the carrier. The clamping means, preferably, comprises a fixed cam member in which the rotatable interlocking member is journalled, an abutment member mounted on the rotatable interlocking member, and a second cam member mounted on the interlocking member between the fixed cam member and the abutment member and rotatable relative to the interlocking member for positively urging the interlocking member slidably towards the base structure of the carrier for clamping the carrier to the carrier stacked thereon when interlocking has been effected. Preferably, also, the position of the abutment member is capable of adjustment along the length of the interlocking member to vary the clamping force exerted by the clamping means.

Preferably, retaining means is provided for retaining the interlocking member in the engaged position and for retaining the clamping means in the engaged position.

According to another aspect of this invention, a freight carrier comprises a base structure, forming a freight carrying platform, having a post member at each corner thereof which is pivotally mounted on the base structure so as to be capable of being selectively pivoted between a folded position in which the post member lies parallel to and adjacent to the base structure and an erect upright position, and locking apparatus for locking the post in the erect upright position wherein the locking apparatus includes interlocking means for locking the post member to the base structure and clamping means for positively clamping the post to the base structure after the interlocking means has been engaged.

The post member is thus not only locked in the erect upright position but is positively clamped to the base structure to improve the rigidity of the post in the erect position.

Preferably, the locking apparatus is mounted on the base structure of the carrier adjacent to each post member. The interlocking means for locking the post member to the base structure, preferably, comprises a rotatable interlocking member having a head which can pass through a hole in the associated post member when the interlocking member is in a disengaged position, but is prevented from passing through that hole when the rotatable member is turned into an engaged position. Preferably, the hole in which the rotatable interlocking member engages is formed in a locking plate extending from the side of the post member.

Preferably, also, the rotatable interlocking member is slidably movable relative to the base structure of the carrier along the rotational axis thereof and the clamping means urges the interlocking member slidably towards the base structure of the carrier. The clamping means, preferably, comprises a fixed cam member in which the rotatable interlocking member is journalled, an abutment member mounted on the rotatable interlocking member, and a second cam member mounted on the interlocking member between the fixed cam member and the abutment member and rotatable relative to the interlocking member for positively urging the interlocking member slidably towards the base structure for clamping the post member to the base structure in its erect position.

Preferably, retaining means is provided for retaining the interlocking member in the engaged position and for retaining the clamping means in the engaged position.

The connecting apparatus of said one aspect to this invention and the locking apparatus of said other aspect of this invention are, preferably, constituted by a single apparatus which performs a dual function.

A preferred embodiment of this invention will now be described, by way of example only, with reference to the accompanying drawings of which:

Figure 1:
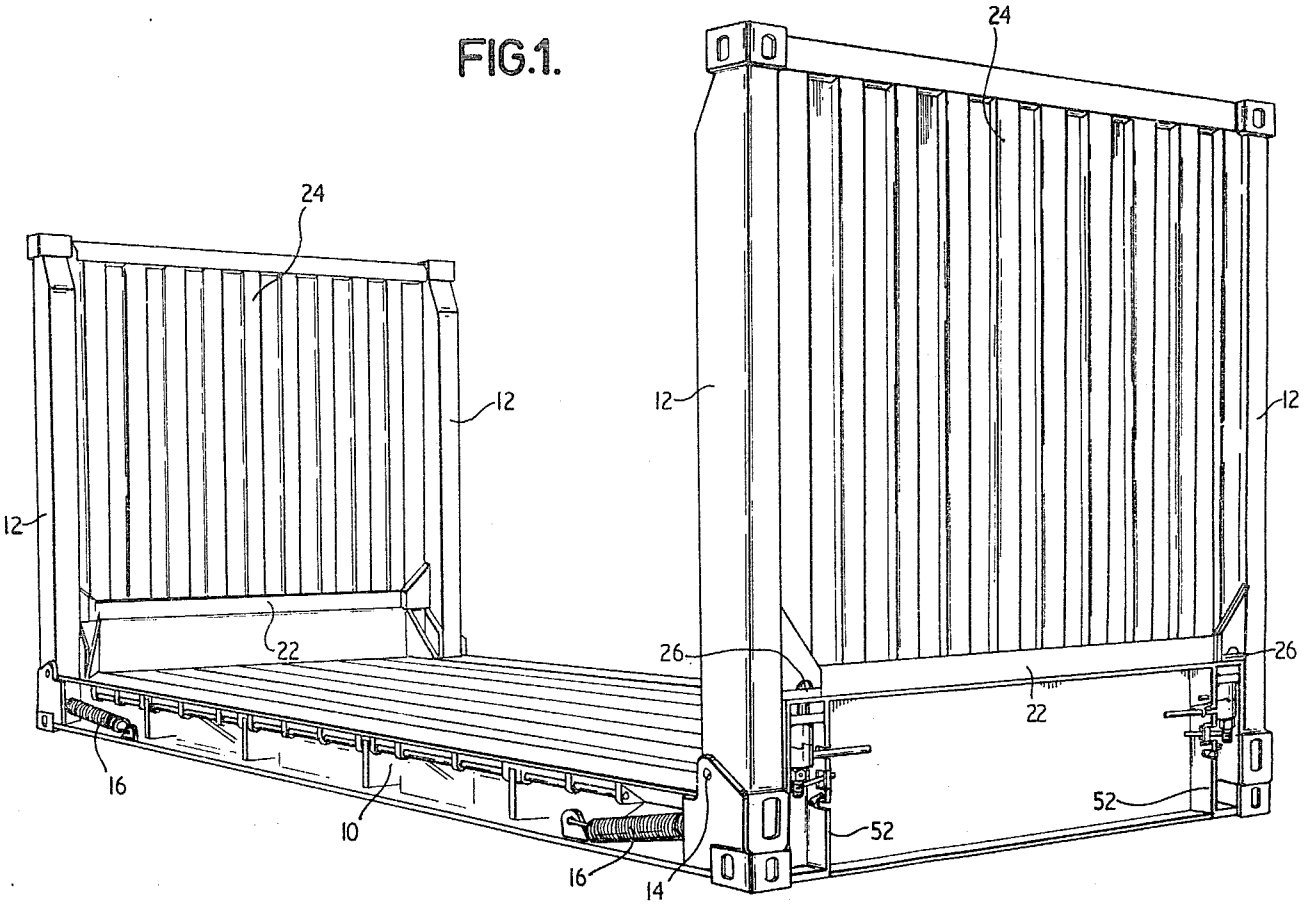
FIG. 1 is a perspective view of a freight carrier.
Figure 2:
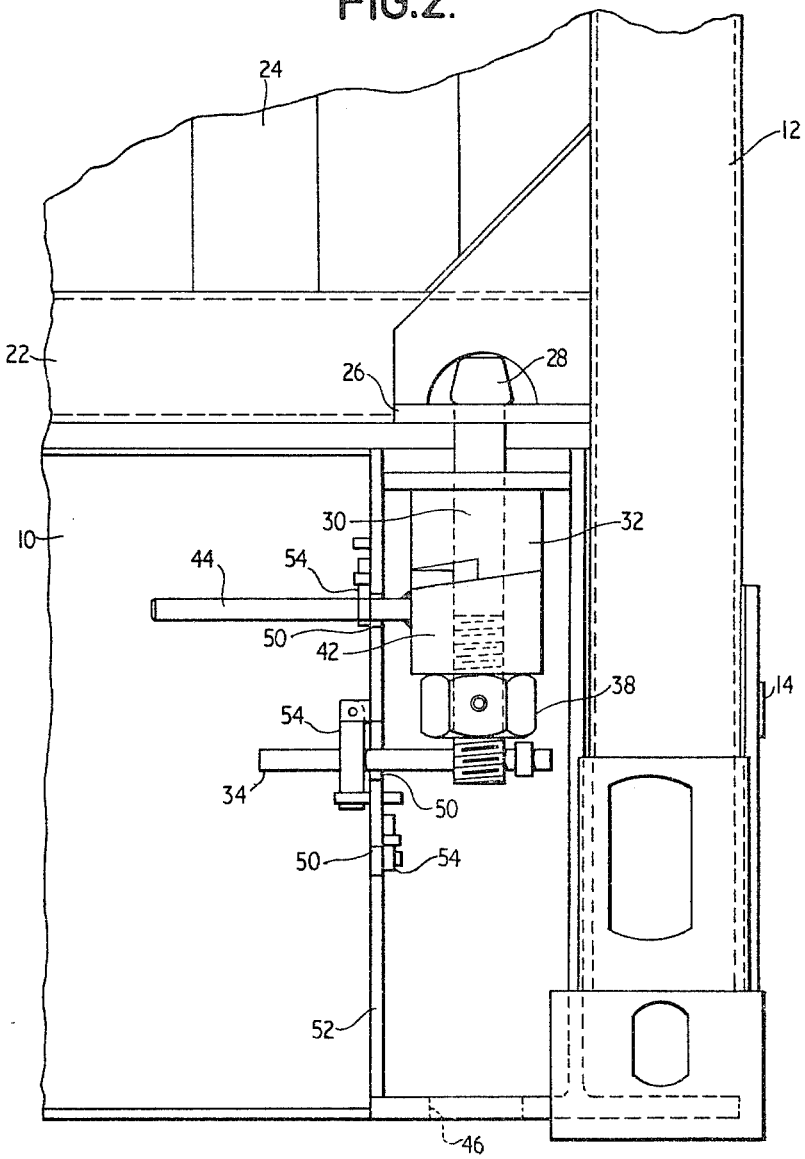
FIG. 2 is an end elevation of one corner of the freight carrier.
Figure 3:
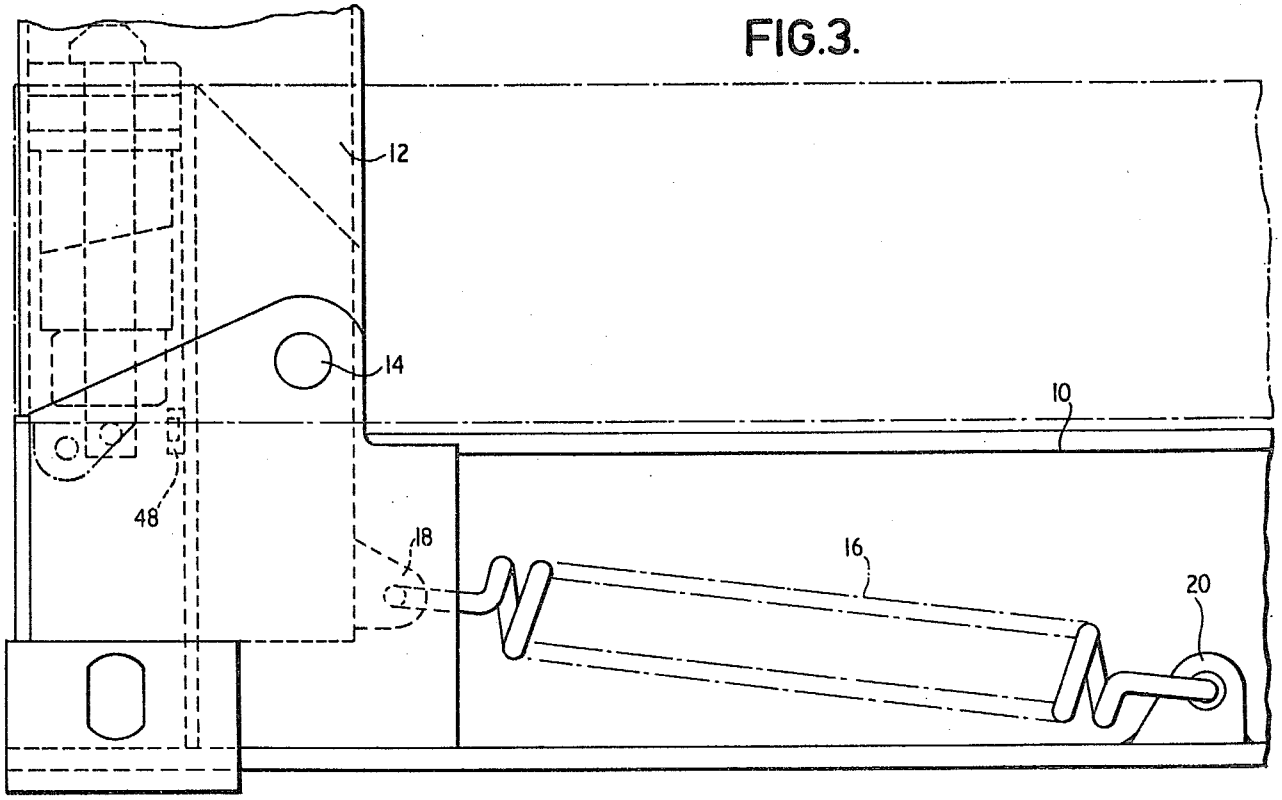
FIG. 3 is a side elevation of the corner of the freight carrier shown in FIG. 1.
Figure 4:
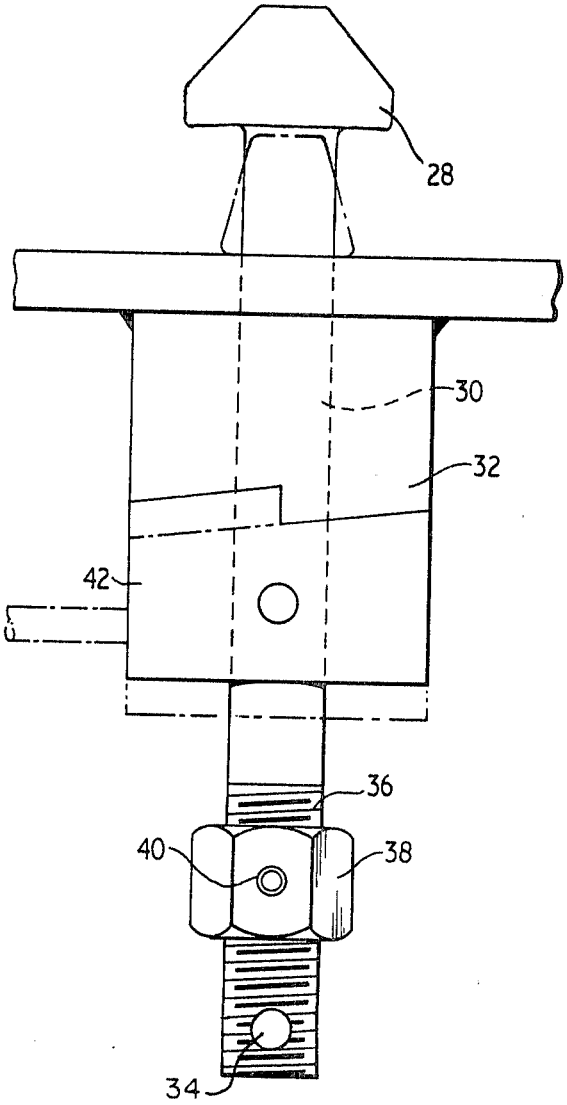
FIG. 4 is an end elevation to an enlarged scale of part of an interconnecting apparatus shown in FIG. 1.

Referring now to the drawings, a freight carrier or container of the type usually known as a cargo flat comprises a substantially flat rectangular base structure 10 forming a freight carrying platform. A post member 12 is pivotally mounted on the base structure at each corner thereof by means of a pivot pin 14 and is capable of being moved between a folded position in which the post member 12 lies parallel to and adjacent to the base structure 10 and an erected position shown in FIGS. 1, 2 and 3 of the drawings in which the post member 12 extends perpendicularly upward from the base structure 10.

The pivot pin 14 is spaced-apart from the lower end of the post member 12 and a helical coil tension spring 16 is connected between a lug 18 on the lower end of the post member 12 and a lug 20 formed on the base structure 10 of the carrier. The spring 16 is arranged to be extended in length as the post member 12 is pivoted downwardly from the erect to the folded position and thus exerts a force on the post member 12 which urges the post member 12 towards the erect position thus counterbalancing at least part of the weight of the post member 12.

The two post members 12 at each end of the carrier are permanently connected together by cross members 22 and plates 24 to form a unitary end structure and when the post members 12 have been erected sides of the carrier can be formed by connecting additional cross members (not shown) between the two post members 12 associated with each side of the carrier.

Each post member 12 has a locking plate 26 secured thereto, which when the post member 12 is in the erected position lies adjacent to and parallel to the upper surface of the base structure 10 at one side of the post member 12. The locking plate 26 is provided with a substantially rectangular aperture (not shown) through which a head portion 28 of a rotatable locking member 30 can extend.

The rotatable locking member 30 is journalled in a bore of a fixed cam member 32 which is secured to the base structure 10 of the carrier. The head portion 28 of the locking member 30 conforms closely in shape to the shape of the aperture (not shown) in the locking plate 26 so that in a disengaged position of the locking member 30 the head portion 28 thereof can pass through the aperture in the plate 26.

The locking member 30 is provided at the end thereof remote from the head portion 28 with a handle 34 by means of which the member 30 can be rotated from the disengaged position in which the head portion 28 is aligned with and can pass through the aperture (not shown) in the locking plate 26 to an engaged position in which the ends of the head portion 28 engage on the upper surface of the plate 26. The locking member 30 is not only rotatable but is also slidable in the fixed cam member 32 so that the member 30 can be moved slidably upwards a sufficient distance to allow the head portion 28 to pass completely through the aperture (not shown) in the locking plate 26 and then be rotated into the engaged position to connect the post member 12 to the base structure 10. The locking member 30 is provided adjacent to its lower end with a screw-threaded portion 36 on which is screwed a nut 38 forming an abutment. The nut 38 is capable of adjustment on the screw-threaded portion 36 of the locking member 30 and is retained in adjusted position by a locking screw 40 mounted therein which is adapted to engage the screw-threaded portion 36 when the screw 40 is tightened.

A rotatable cam member 42 is mounted on the locking member 30 between the fixed cam member 32 and the nut 38. The cam member 42 is provided with a handle 44 by means of which the cam member 42 can be rotated relatively to the fixed cam member 32 from a disengaged position to an engaged position shown in FIG. 2 of the drawings.

During movement of the cam member 42 from the disengaged to the engaged position, the interaction of the cam surfaces of the cam members 32 and 42 produces downward movement of the cam member 42 which due to the engagement thereof with the nut 38 produces corresponding downward movement of the locking member 30 whose head portion 28 thus exerts a clamping force on the locking plate 26 to clamp the post member 12 securely and positively in the erect position. The clamping force exerted can be adjusted by movement of the nut 38 on the locking member 30.

The lower portion of the base structure 10 is also provided with a similar aperture 46 to the one in the locking plate 26 so that when the post members 12 are in their folded positions and a similar carrier is stacked upon the present carrier, the locking member 30 can be engaged in this aperture and the two superposed carriers locked and clamped together.

The handle 34 is slidably mounted in a bore formed in the end of the locking member 30 and is capable of limited sliding movement along the axis of the handle 34 transversely of the locking member 30. The handle 34 extends through the locking member 30 and the end thereof projecting from the rear of the locking member 30 is adapted to engage in a blind bore of a bush 48 which is mounted on the base structure 10 so that when the locking member 30 is rotated to the disengaged position the head portion 28 thereof can be secured in a position in which it projects above the plate 26 thereby forming a means of accurately locating the similar carrier thereon in a position in which the two superposed carriers can be locked together.

The locking member and the cam member 42 can be retained in their engaged positions by inserting the handles 34 and 44 associated therewith in the appropriate one of three open ended slots 50 formed in a web portion 52 of the base structure 10 of the carrier and each of the slots 50 is provided with an associated releasable pivotally mounted catch 54 behind which the associated handle 34 or 48 can be disposed to be retained in the associated slot 50.

I claim:

1. A freight carrier comprising a base structure forming a freight carrying platform and connecting apparatus for releasably connecting the carrier to a similar carrier which is stacked thereon, wherein the connecting apparatus includes interlocking means for interlocking the superposed carriers together, said interlocking means of the connecting apparatus comprising a rotatable interlocking member having a head which can pass through a hole in a base structure of the similar carrier stacked on the carrier having the interlocking means when the rotatable interlocking member is in a disengaged position on its carrier, but is prevented from passing through that hole when the rotatable member is turned into an engaged position, and clamping means for urging said interlocking means towards said base structure to thereby draw the superposed carriers together after interlocking has taken place, said clamping means including a member rotatable about a portion of said interlocking means, said interlocking means portion being linearly slidable through said clamping means member, said clamping means further comprising a cam member fixed to the base structure in which the rotatable interlocking member is journalled, and an abutment member mounted on the rotatable interlocking member, said clamping means member comprising a second cam member mounted on the interlocking member between the fixed cam member and the abutment member and rotatable relative to the interlocking member for positively urging the interlocking member slidably towards the base structure of the carrier for clamping the carrier to the carrier stacked thereon when interlocking has been effected.

2. A freight carrier according to claim 1, wherein the position of the abutment member is capable of adjustment along the length of the interlocking member to vary the clamping force exerted by the clamping means.

3. A freight carrier comprising a base structure, forming a freight carrying platform, having a post member at each corner thereof which is pivotally mounted on the base structure so as to be capable of being selectively pivoted between a folded position in which the post member lies parallel to and adjacent to the base structure and an erect upright position, and locking apparatus for locking the post in the erect upright position, wherein the locking apparatus includes interlocking means for locking the post member to the base structure, said interlocking means for locking the post member to the base structure comprising a rotatable interlocking member having a head which can pass through a hole in the associated post member when the interlocking member is in a disengaged position, but is prevented from passing through that hole when the rotatable member is turned into an engaged position, and clamping means for urging said interlocking means toward said base structure to thereby positively clamp the post to the base structure after the interlocking means has been engaged, said clamping means including a member rotatable about a portion of said interlocking means, said interlocking means portion being linearly slidable through said clamping means member, said clamping means further comprising a cam member fixed to the base structure in which the rotatable interlocking member is journalled, and an abutment member mounted on the rotatable interlocking member, said clamping means member comprising a second cam member mounted on the interlocking member between the fixed cam member and the abutment member and rotatable relative to the interlocking member for positively urging the interlocking member slidably towards the base structure for clamping the post member to the base structure in its erect position.

* * * * *